United States Patent [19]

Mayer

[11] 4,121,313

[45] Oct. 24, 1978

[54] CLEANING TOOL FOR POLISHING PADS

[76] Inventor: Frederich K. Mayer, 404 154th Pl., Calumet City, Ill. 60409

[21] Appl. No.: 800,741

[22] Filed: May 26, 1977

[51] Int. Cl.[2] ..... B08B 11/00

[52] U.S. Cl. ..... 15/3; 15/93 R; 15/387

[58] Field of Search ..... 15/3, 142, 93 R, 210.5, 15/344, 387, 236 R, 236 C, 24, 382, 375; 29/81.11; 118/102; 101/328

[56] References Cited

U.S. PATENT DOCUMENTS 1,599,713 9/1926 Perlman ..... 15/93 R X

FOREIGN PATENT DOCUMENTS 1,313,111 11/1962 France ..... 15/210.5

573,940 12/1945 United Kingdom ..... 15/210.5

*Primary Examiner*—Edward L. Roberts

[57] ABSTRACT

A cleaning tool for polishing pads, the tool divided at the front end to journal a transverse roller whose periphery has a plurality of headed studs. The tool is tubular with said end directing a nozzle toward the roller; and the rear end has a valve for connecting a compressed-air supply and a finger-operated lever for controlling the valve, whereby to blow an air jet against the periphery of the roller.

6 Claims, 4 Drawing Figures

FIG. 1
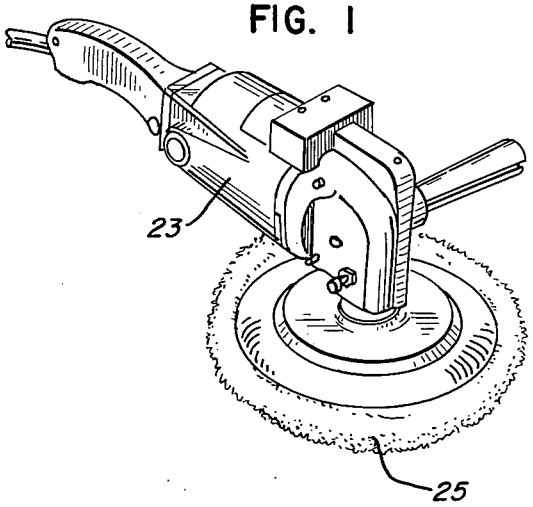
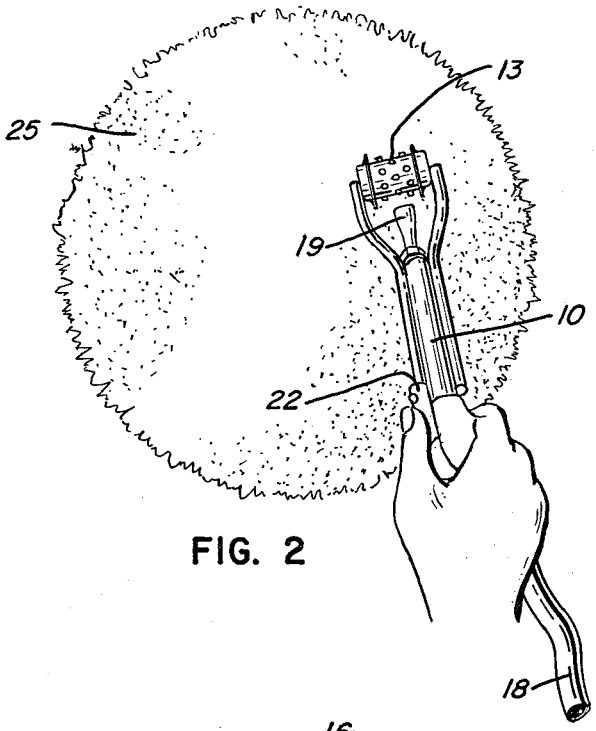
FIG. 2
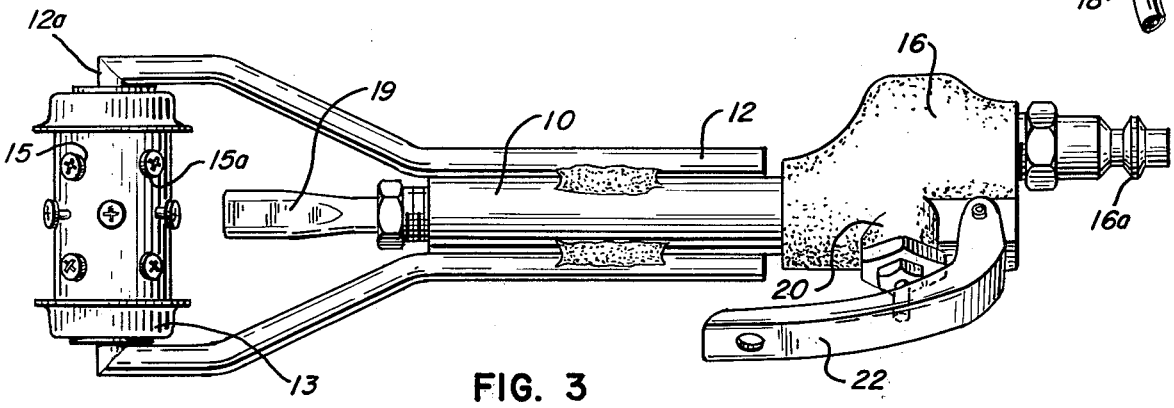
FIG. 3
FIG. 4
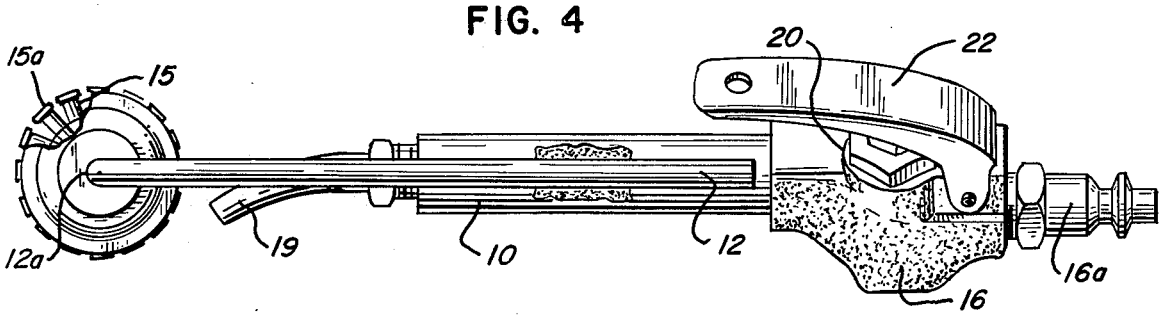

CLEANING TOOL FOR POLISHING PADS

My invention relates to the rotary polishing pads applied to the surfaces of automobile bodies for producing a glossy finish. Such pads are carried by an electric hand tool or appliance; and they are usually coated with a compound designed to clean the surface to which they are applied and impart a high luster to the same. However, extended use of such a pad causes it to harden and mat down in its surface from the absorption and drying of damp cleaning compound, and to give off fluff from its working surface, so that it loses the soft and full application of the same. It is therefore one object of the present invention to provide a tool which engages the surface of the rotating pad with the sweeping action designed to break up clotted fibers and surface layers congealed with polishing compound, and sweep fluff and lint out of the surface of the pad.

A further object is to provide a tool for the above purpose with a studded roller for sweeping through the surface fibers of the pad, and use forced air to eject all foreign matter stirred up by the roller.

Another object is to design the invention as a light tool suitable for handy connection to any compressed air conduit and with a thumb-operated air control.

A better understanding of the invention may be gained by reference to the accompanying drawing, in which—

FIG. 1 is a perspective view showing how the polishing pad is carried by a conventional electric polishing appliance;

FIG. 2 is a perspective view of the under side of the pad, showing the manner in which the tool is applied to the same;

FIG. 3 is a plan view of the tool, approximately two-thirds size; and

FIG. 4 is a side view of the showing in FIG. 3.

Referring specifically to the drawing, 10 denotes the shank of the tool, which is preferably of round tubing, although its shape may differ according to design. The shank carries two arms 12 at the sides, which separate sidewise and terminate with inward bends 12*a;* and a cylindrical roller 13 is journaled on the bends for free rotation. FIG. 3 shows that the surface of the roller has a considerable number of studs 15 projecting from it; and these are formed with round heads. The shank 10 is extended from the rear with a housing 16 which serves as a handle for the tool. The housing has a rearwardly projecting nipple 16*a* designed to receive a compressed air supply hose 18. Thus, compressed air may enter the housing, pass through the shank 10, and issue from a nozzle 19 which projects from the front end of the shank in the direction of the roller 13. The housing has a valve 20 controlling the entrance of compressed air, and a handle 22 at the side which may be pressed with the thumb as seen in FIG. 2 in order to induce or control the passage of compressed air through the housing. The stud heads are marked 15*a*.

The electric appliance which carries the rotary polishing pad is shown at 23 in FIG. 1, and the disc-shaped polishing pad at 25. When the pad is to be cleaned the appliance is turned on and positioned with the rotary pad on the upper side, so that its surface is fully accessible to the tool applied as shown in FIG. 2. The rotation of the pad will, through engagement with the studs 15, cause the roller 13 to spin; and this action will cause the studs to sweep between the fibers of the pad, and separate them. Also, the heads of the studs will break up regions where residue of cleaning compound has clotted or hardened, loosening the same. During this action the operator actuates the handle 22 to direct a jet of compressed air against the rotating roller. Thus, cleaning compound, fluff and lint picked up by the roller is continuously blown off the same; and the discharge of compressed air also blows all loose material off the pad, accomplishing the complete cleaning of the same.

It is now apparent that the improved pad cleaning tool is an accessory which operates like a power tool, yet is not power-connected and therefore devoid of complications. The roller does not drive anything that could become tangled or snagged in fluff or threads issuing from the surface of the pad. In other words, the pad drives the roller, which is free to turn; and the jet of compressed air directed against the roller scatters all accumulations of loose fibers, fluff and dust of cleaning compound stirred up by the studs of the roller, so that it may always operate at full efficiency. Further, using a compressed air jet in the tool accomplishes a more thorough cleaning of damp and clogged pads; and combining the compressed air feature with the shank of the tool makes the latter simple and compact.

I claim:

1. A cleaning tool for rotary polishing pads comprising an elongated shank presenting bearing means at one end, a transverse cylindrical roller journaled on the bearing means, a plurality of studs projecting from the periphery of the roller, and means carried by the shank and operable to direct a jet of compressed air against said periphery.

2. The structure of claim 1, said bearing means comprising a pair of arms carried alongside the shank and extending opposite the ends of the roller, and terminal bends from the arms entering axially into said ends.

3. The structure of claim 1, said bearing means comprising a pair of arms carried alongside the shank and separating to lie opposite the ends of the roller, and terminal bends from the arms entering axially into said ends.

4. The structure of claim 1, the shank being tubular with a nozzle at one end directed toward said periphery, and a compressed air supply connection into the other end of the shank.

5. The structure of claim 1, the shank being tubular with a nozzle at one end directed toward said periphery, a compressed air supply connection into the other end of the shank, and a valve between the latter and the connection for controlling said supply.

6. The structure of claim 5, and a lever carried by the valve for controlling the same and operable by finger pressure.

* * * * *